US007083463B2

(12) United States Patent
Steinkemper et al.

(10) Patent No.: US 7,083,463 B2
(45) Date of Patent: Aug. 1, 2006

(54) ELECTRICAL SUPPLY OR CONNECTING TERMINAL

(75) Inventors: Anke Steinkemper, Leopoldshoehe (DE); Udo Hoppe, Blomberg (DE); Ralf Geske, Schieder-Schwalenberg (DE); Dieter Holste, Detmold (DE); Thomas Beier, Schloss Holte-Stukenbrock (DE); Ralf Lange, Horn-Band Meinberg (DE); Markus Kettern, Lemgo (DE); Sebastian Schaefer, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 11/226,441

(22) Filed: Sep. 15, 2005

(65) Prior Publication Data

US 2006/0063419 A1 Mar. 23, 2006

(30) Foreign Application Priority Data

Sep. 15, 2004 (DE) ..... 10 2004 045 025

(51) Int. Cl.
*H01R 4/24* (2006.01)

(52) U.S. Cl. ..... 439/441; 439/834

(58) Field of Classification Search ..... 439/441, 439/440, 436, 437, 834–836
See application file for complete search history.

(56) References Cited

U.S. PATENT DOCUMENTS

| | | | | |
|---|---|---|---|---|
| 6,074,242 | A * | 6/2000 | Stefaniu et al. | 439/441 |
| 6,280,233 | B1 * | 8/2001 | Beege et al. | 439/441 |
| 6,336,824 | B1 * | 1/2002 | Sorig | 439/441 |
| 6,911,602 | B1 * | 6/2005 | Conrad | 174/68.2 |
| 2004/0161962 | A1 * | 8/2004 | Kikuchi | 439/441 |

FOREIGN PATENT DOCUMENTS

| | | |
|---|---|---|
| DE | 198 17 927 C1 | 10/1999 |
| DE | 101 03 107 A1 | 7/2002 |

* cited by examiner

*Primary Examiner*—Hien Vu
(74) *Attorney, Agent, or Firm*—David S. Safran

(57) ABSTRACT

An electrical supply or connecting terminal with a clamping spring and a metal part, the clamping spring having a clamping leg and a contact leg, and the metal part having a conductor bar piece. The clamping leg and the conductor bar piece form a spring force clamp connection for the electrical conductor. The contact leg of the clamping spring has a recess for insertion of the electrical conductor, and an end of the clamping leg extends through the recess. The clamping spring has a retaining section which runs essentially parallel to the insertion direction of the electrical conductor and parallel to the conductor bar piece and the conductor bar piece has been inserted though the recess in a direction opposite the insertion direction of the electrical conductor, the conductor bar piece being clamped securely between the end of the clamping leg and the retaining section.

15 Claims, 3 Drawing Sheets

ELECTRICAL SUPPLY OR CONNECTING TERMINAL

BACKGROUND OF THE INVENTION

1. Field of Invention

The invention relates to an electrical supply or connecting terminal with a clamping spring and with a metal part, the clamping spring and the metal part being located in an insulating housing which has a conductor entry opening for entry of an electrical conductor which is to be connected, the clamping spring having a clamping leg and a contact leg and the metal part having at least one conductor bar piece, the clamping leg and the conductor bar piece forming a spring force terminal connection for the electrical conductor to be connected.

2. Description of Related Art

Electrical terminal means or connecting means are used to establish an electrical terminal or electrical connection, specifically to produce an electrically conductive connection, specifically a metallic connection, between a contact element and a mating contact element. Whether in the individual case there is a terminal means or a connecting means, is functionally relatively unimportant. It is often considered a terminal means when something locally movable is connected to something locally stationary, while often it is considered a connecting means when something locally movable is connected to something locally movable or even when something locally stationary is connected to something locally stationary.

A supply terminal of the initially described type is known, for example, from German Patent Application DE 101 03 107 A1. In the known supply terminal, the metal part is made as a repeatedly bent contact element that has a first profile section which runs essentially perpendicular to the insertion direction of the conductor which is to be connected and has a plug opening for the conductor, and a second profile section which is bent away from the first profile section in the insertion direction. The clamping spring, which is made essentially U-shaped, projects with its clamping leg through the plug opening in the contact element so that the end of the clamping leg presses an electrical conductor which has been inserted into the plug opening against the second profile section of the contact element. The contact element and the clamping spring thus form a spring force clamp connection for an electrical conductor which is to be connected.

The clamping spring is connected to the contact element by the end of the second leg of the clamping spring being riveted securely to the contact element above the plug opening. In the known supply terminal, the fixing of the clamping spring on the contact element by means of rivets is comparatively involved. Moreover, the size of the known supply terminal is relatively large; in particular, the supply terminal is relatively tall since, by fixing the second leg of the clamping spring above the plug opening the rear spring arc of the clamping spring is also located essentially above the approximately L-shaped contact element.

German Patent DE 198 17 927 C1 discloses an electrical supply terminal which likewise has an essentially U-shaped clamping spring and a L-shaped metal part. The metal part is connected to a plug or socket part so that the known supply terminal is also called a plug-in connector. The L-shaped metal part has a component piece which is located perpendicular to the conductor entry direction with a rectangular opening being formed through which the electrical conductor to be connected can be inserted. The ends of the legs of the U-shaped clamping spring are located in the opening such that the rear spring arc of the clamping spring is located, in the conductor inlet direction, in front of the opening and the clamping leg of the clamping spring presses the inserted electrical conductor against the top edge of the opening so that, in this known plug-in connector, the clamping spring and the metal part also form a spring force clamp connection. When the clamping spring is opened with an actuating tool, there is the danger that the clamping spring will slip or the ends of its spring legs will even slip out of the opening so that proper positioning of the clamping spring when an electrical conductor is being inserted, and thus reliable contact-making of the electrical conductor are no longer guaranteed under certain circumstances.

SUMMARY OF THE INVENTION

Therefore, a primary object of this invention is to provide an electrical supply or connecting terminal of the initially described type which enables simple, but secure fixing of the clamping spring for a size as small as possible.

This object is achieved in the initially described electrical supply or connecting terminal in that, in the contact leg of the clamping spring, a recess is formed for insertion of the conductor, that the clamping leg and the contact leg of the clamping spring are bent toward one another such that the end of the clamping leg extends through the recess in the contact leg, and that the clamping spring has a retaining section which runs essentially parallel to the insertion direction of the electrical conductor which is to be connected and parallel to the conductor bar piece such that the conductor bar piece can be inserted though the recess opposite the insertion direction of the conductor which is to be connected, the conductor bar piece being clamped securely between the end of the clamping leg and the retaining section.

The electrical supply or connecting terminal of the invention differs from supply terminals known from the prior art, first of all, in that the clamping spring is not U-shaped, but rather is loop-shaped. Moreover, in the electrical supply or connecting terminal of the invention, the recess for insertion of the electrical terminal to be connected is not made in a component piece of the conductor bar, but in the contact leg of the clamping spring. In the supply or connecting terminal in accordance with the invention, the clamping spring and the conductor bar are not fixed by the clamping spring with the ends of its legs being inserted into the opening in the conductor bar, but the conductor bar being inserted into the recess in the contact leg of the clamping spring.

To attach the clamping spring relative to the metal part, a retaining section is formed on the clamping spring so that the conductor bar piece is securely clamped between the end of the clamping leg and the retaining section. As in the prior art, the end of the clamping leg and the conductor bar piece form a clamping site for the electrical conductor in which the end of the clamping leg presses the electrical conductor which is to be connected against the conductor bar piece.

Loop-shaped clamping springs in electrical supply terminals or connecting terminals are basically known from the prior art, specifically as so-called tension springs in tension spring terminals. Tension spring terminals have become established on the market over time, in addition to screw terminals and recently also besides electrical terminals with insulation piercing terminal technology, and have been used millions of times especially as modular terminals. The advantage of tension spring terminals as compared to screw terminals is that the tension spring terminals enable faster and easier wiring. To actuate a tension spring terminal, only one actuating tool is necessary, for example, a screwdriver, which is pressed into the actuating shaft to open the terminal. In doing so, the tip of the screwdriver tensions the tension spring, by which the clamping site is open. A conductor which is to be connected can then be inserted through the recess into the clamping leg and after pulling out the screwdriver is clamped by the lower edge of the recess against a conductor bar which is connected to the tension spring.

However, the known tension spring terminals differ distinctly both in configuration and also in their function from supply terminals or connecting terminals to which the present invention is directed. In the known loop-shaped tension springs, according to their name, the conductor which is to be connected is drawn against the conductor bar by the clamping leg. In contrast, in a supply terminal or connecting terminal, the conductor which is to be connected is pressed against the conductor bar piece by the clamping leg. Moreover, in tension springs there is a recess in the clamping leg, while in the clamping spring of a supply or connecting terminal in accordance with the invention, the recess is made in the contact leg.

According to one advantageous embodiment of the invention, the retaining section of the clamping spring is punched out of the contact leg and bent down. The retaining section corresponds to the material of the contact leg which is punched out of the contact leg when the recess is formed. Thus, the recess and the retaining section can be produced especially easily and in a material-saving manner by a punching and bending process. Moreover, because the contact leg and retaining section are in one piece, a further process step is not necessary for connecting the retaining section to the clamping spring.

According to another advantageous embodiment of the invention, the end of the conductor bar piece is bent down such that the end of the conductor bar piece, together with the end of the clamping leg of the clamping spring, form an inlet funnel for the electrical conductor to be connected. Thus, the execution of the inlet funnel automatically correctly positions the tip of an electrical conductor which has been pushed through the conductor inlet opening into the insulating housing so that simple and exact connection of the electrical conductor to the electrical supply or connecting terminal is possible.

As already stated, the electrical terminal means or connecting means is preferably made as a plug-in connector so that the metal part besides the conductor bar piece has a plug or socket part, the conductor bar piece and the plug or socket part being made in one piece so that the metal part can be altogether easily produced simply by punching and bending.

Good electrical plug-in connectors are characterized in that, in the state in which contact has been made, the contact resistance between the contact element, i.e., the plug part or socket part, and the corresponding mating contact element, permanently has a value which is as low as possible. The contact resistance between the contact element and the mating contact element which has made contact with the contact element depends on the geometry of the contact element and the mating contact element, on the materials of the contact element and the mating contact element, and especially, on the contact force or the contact pressure between the contact element and the mating contact element. The contact force is generally achieved in that, when contact is made, the contact element is elastically deformed so that a reset force, as contact force, and as a result, a corresponding contact pressure, is formed from the elastic deformation.

The problem at this point is that, when using a material with good conductivity for the contact element, i.e., for the plug part or socket part of the metal part, the spring constant of the contact element is relatively low so that sufficient and permanent contact force cannot be accomplished. According to one advantageous embodiment of an electrical supply terminal or connecting terminal, by providing a socket part which has two opposing legs and a bridge which connects the legs, this disadvantage is eliminated by there being an over-spring which surrounds the socket part. The over-spring which is matched essentially to the geometry of the socket part can be produced, for example, from spring steel. In contrast, the metal part, and thus also the socket part itself, are made of a material with good conductivity, for example, of a copper alloy.

According to a another advantageous embodiment of the invention, which will be briefly mentioned here, the insulating housing has an actuating opening for insertion of an actuating tool, and on the clamping leg of the clamping spring, a kink is made which is aligned in the direction of the spring force of the clamping leg so that the tip of the actuating tool can act on the kink for opening the clamping spring. Providing an actuating opening for insertion of an actuating tool, first of all, results in that the electrical supply or connecting terminal can also be used for fine wire flexible conductors in which opening of the clamping spring simply by inserting the electrical conductor is not possible. Moreover, by opening the clamping spring using the actuating tool, an already clamped electrical conductor can be released from the clamping site. The kink made on the clamping leg enables easier action of the tip of the actuating tool on the clamping leg for opening the clamping spring.

In particular, there are many possibilities for embodying and developing the electrical supply or connecting terminal in accordance with the invention. In this respect, reference is made to the following description of in conjunction with the accompanying drawings.

DETAILED DESCRIPTION OF THE INVENTION

Figure 1:
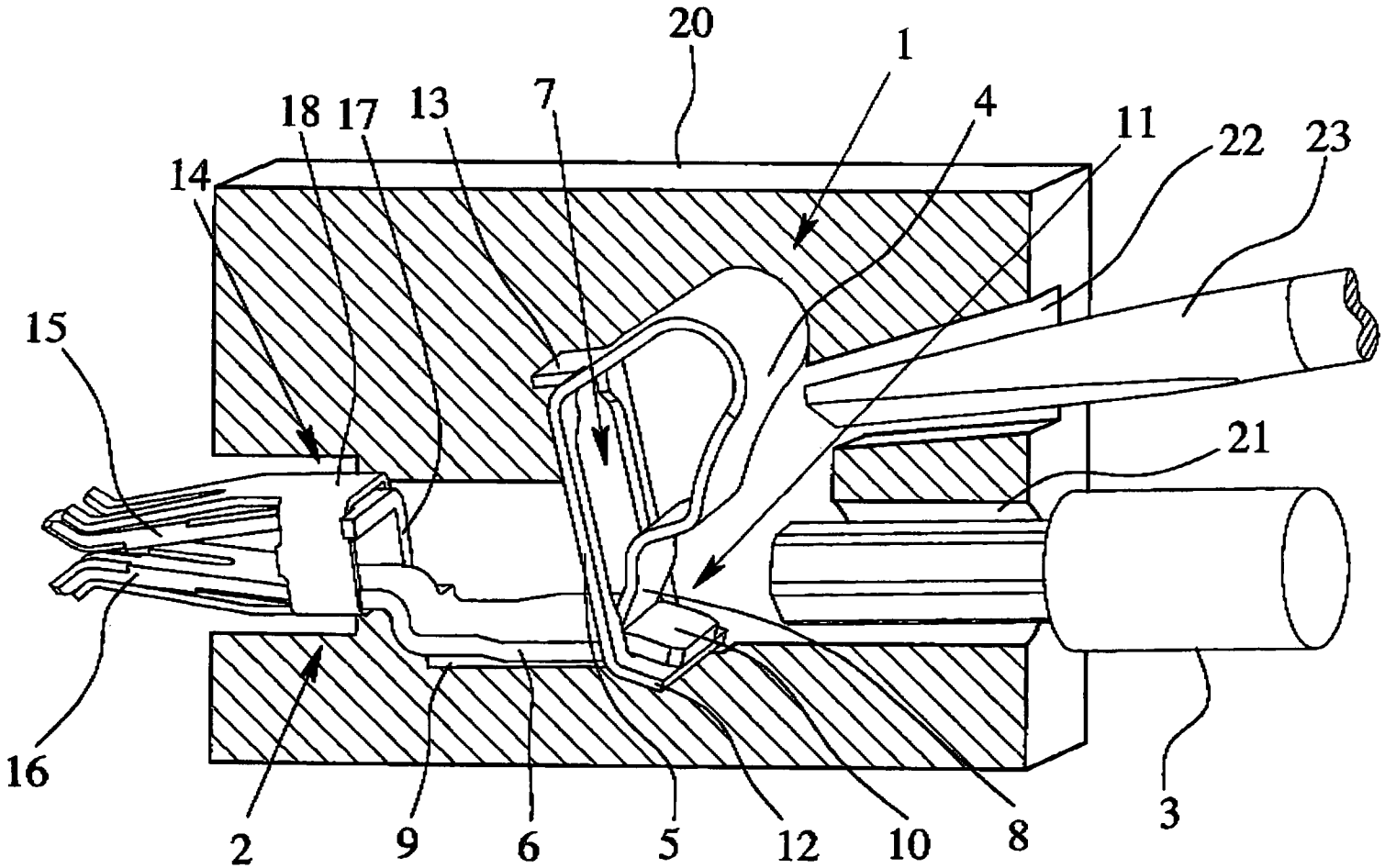
FIG. 1 is a perspective view of an electrical supply or connecting terminal in accordance with the invention with a electrical conductor to be connected.
Figure 2:
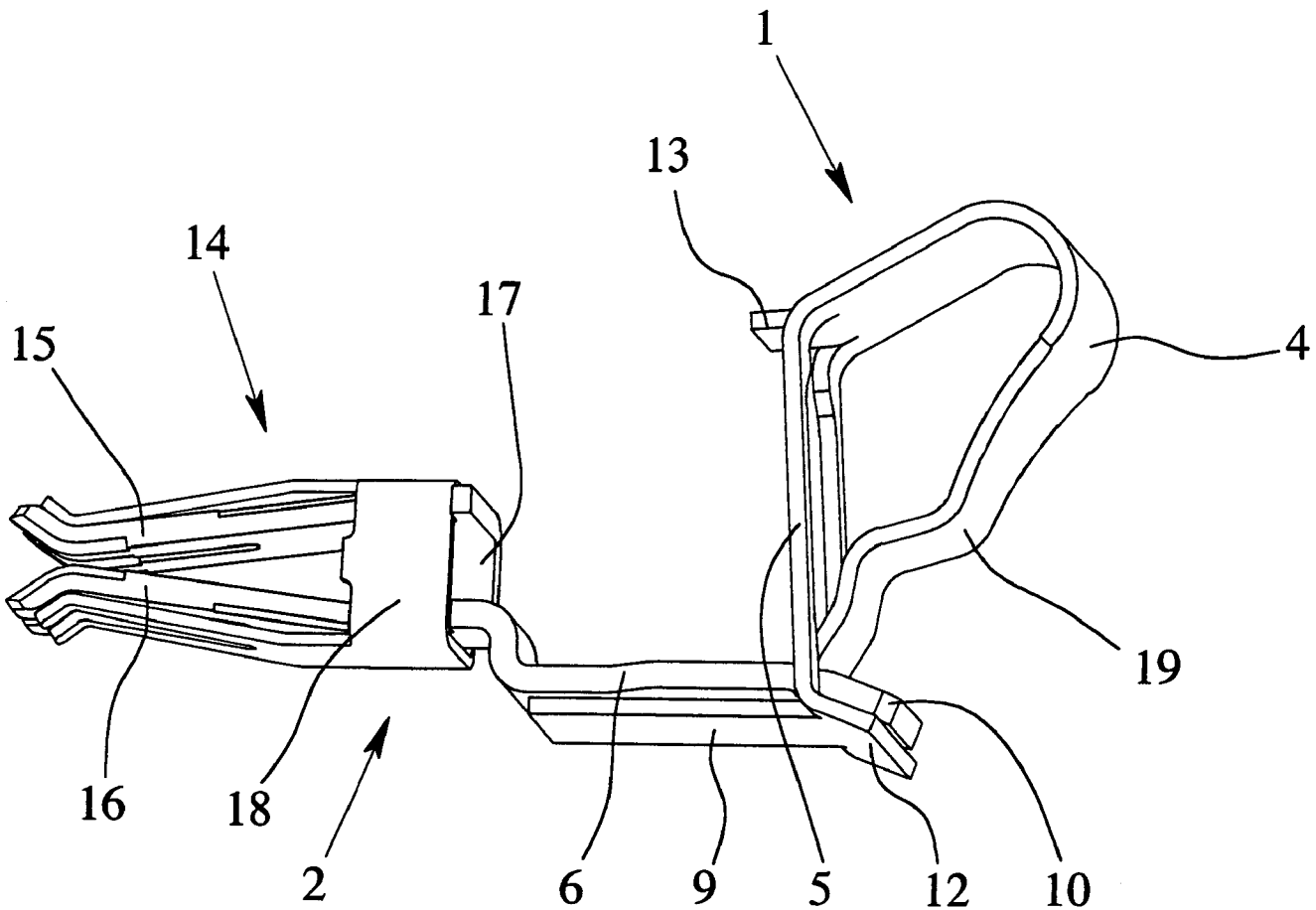
FIG. 2 shows another perspective view of the electrical supply or connecting terminal of the invention.

FIGS. 1 & 2 show a clamping spring 1 and a metal part 2 of an electrical supply or connecting terminal. The electrical supply or connecting terminal includes an insulating housing 20 having an inlet opening 21 for insertion of an electrical conductor 3 which is to be connected, and which is shown in FIG. 1. The clamping spring 1 has a clamping leg 4 and a contact leg 5. The clamping leg 4 and the contact leg 5 run roughly perpendicular to one another in adjoining portions. The metal part 2 has a conductor bar piece 6 and a socket part 14 which is joined integrally to the conductor bar piece 6.

Figure 3:
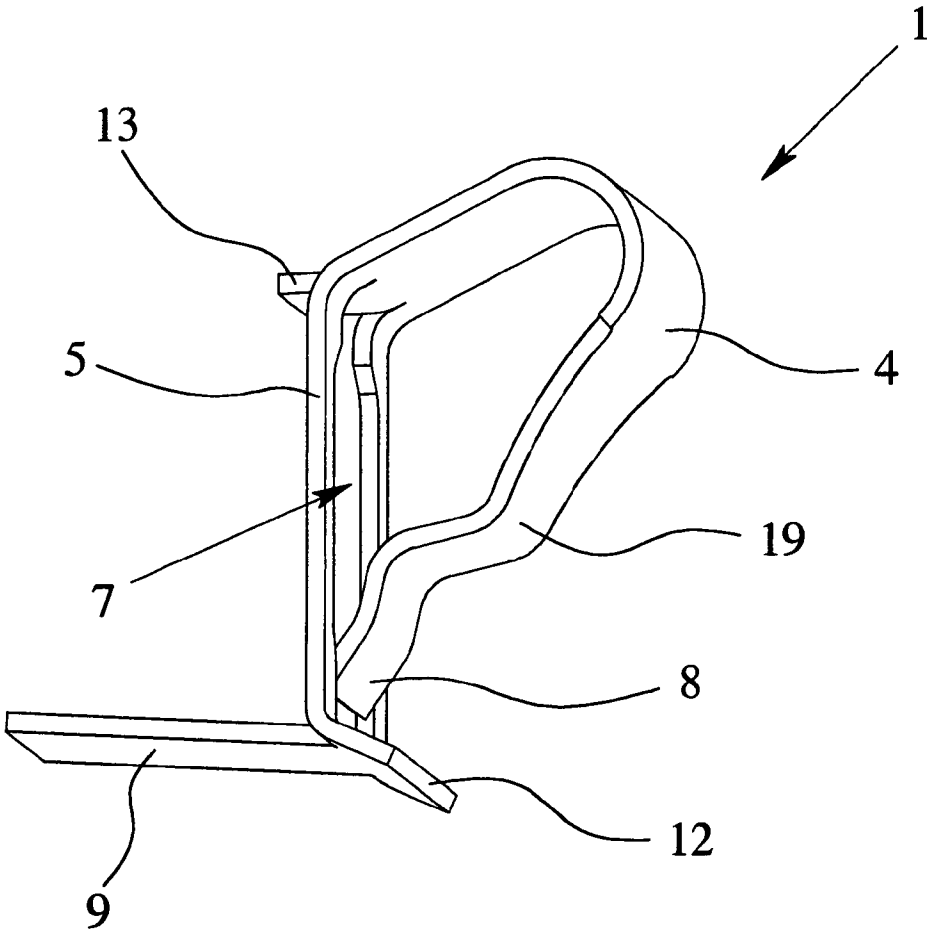
FIG. 3 is a perspective view of the clamping spring of the electrical supply or connecting terminal shown in FIGS. 1 & 2.

As is especially apparent from FIGS. 1 & 3, in the contact leg 5 of the clamping spring 1, a recess 7 is formed into which the tip of the electrical conductor 3 to be connected can be inserted. In the state which is shown in the figures and in which the electrical conductor 3 is not yet connected to the electrical supply or connecting terminal, the end 8 of the clamping leg 4 extends into the recess 7 in the contact leg 5. As a result, the clamping spring 1 has a roughly loop-shaped outline, with the contact leg 5, and thus also the recess 7, running essentially perpendicular to the direction in which the electrical conductor 3 is to be inserted and perpendicular to the conductor bar piece 6.

In addition to the clamping leg 4 and the contact leg 5, the clamping spring 1 has a retaining section 9 which is punched out of the contact leg 5. As the figures show, the contact leg 5 and the retaining section 9 run essentially perpendicular to one another, while the conductor bar piece 6 and the retaining section 9 run essentially parallel to one another.

FIGS. 1 & 2 show that the end 10 of the conductor bar piece 6 is bent, in the illustrated orientation, down, that the end 10 of the conductor bar piece 6 together with the end 8 of the clamping leg 4 forms an inlet funnel 11 for the electrical conductor 3 to be connected. The end 10 of the conductor bar piece 6 has the general shape of the tip of a ski.

Fixing of the clamping spring 1 to the metal part 2 or fixing of the metal part 2 to the clamping spring 1 can be easily produced by the conductor bar piece 6 being inserted opposite the insertion direction of the electrical conductor 3 to be connected through the recess 7, the conductor bar piece 6 resting on the retaining section 9 and being pressed by the end 8 of the clamping leg 4 against the retaining section 9. In doing so the end 10 of the conductor bar piece 6 projects through the recess 7 in the contact leg 5. In this way, both good support of the conductor bar piece 6 on the retaining section 9 and also adequate clamping of the conductor bar piece 6 between the contact leg 5 and the retaining section 9 are ensured. The position of the clamping spring 1 can be further fixed in that, in the insulating housing, a groove or a shoulder is formed for holding or supporting the mounting bridge 13 which, on the end of the recess 7 opposite the retaining section 9, is punched out of the contact leg 5 and bent down.

In the embodiment shown in FIGS. 1 & 2, the metal part 2, in addition to the conductor bar piece 6, has a socket part 14. Instead of the socket part 14 shown here, the conductor bar piece 6 can also be connected to a pin-shaped plug part. To increase the contact force of the socket part 14 that has two opposing elastic legs 15, 16 and a bridge 17 which connects the two legs 15, 16, there is an over-spring 18 which is matched to the geometry of the socket part 14. The metal part 2 altogether, i.e., both the conductor bar piece 6 and also the socket part 14, are produced from a material with good electrical conductivity, especially from a copper alloy, while the over-spring 18 is produced from a material with high spring constant, for example, from spring steel.

The clamping leg 4 of the clamping spring 1 has a kink 19 which is aligned in the direction of the spring force of the clamping leg 4 so that the kink 19 implements an improved action point for the tip of an actuating tool 23 for opening the clamping spring 1, the actuating tool 23 being insertable into an actuating opening 22 in the housing 20. Altogether, the figures show that, in the electrical supply or connecting terminal in accordance with the invention, the fixing of the clamping spring 1 and metal part 2 can be produced especially easily, at the same time a small and compact design of the electrical supply or connecting terminal can be achieved.

What is claimed is:

1. Electrical supply or connecting terminal, comprising an insulating housing which has a conductor inlet opening for entry of an electrical conductor which is to be connected, a clamping spring and a metal part, the clamping spring and the metal part, being located in the insulating housing, the clamping spring having a clamping leg and a contact leg, and the metal part having at least one conductor bar piece, and together, the clamping leg and the conductor bar piece forming a spring force clamp connection for the electrical conductor to be connected, wherein a recess is formed in the contact leg of the clamping spring for insertion of the electrical conductor to be connected, wherein the clamping leg and the contact leg of the clamping spring are bent toward one another such that a free end of the clamping leg extends through the recess, wherein the clamping spring has a retaining section which runs essentially parallel to an insertion direction of the electrical conductor which is to be connected and parallel to the conductor bar piece, and wherein an end of the conductor bar piece has been inserted though the recess in a direction opposite the insertion direction of the electrical conductor to be connected, the conductor bar piece being clamped securely between the free end of the clamping leg and the retaining section, wherein the retaining section of the clamping spring has been punched out of the contact leg and bent down, an area of the contact leg from which the retaining section has been removed defining said recess.

2. Electrical supply or connecting terminal as claimed in claim 1, wherein the end of the conductor bar piece is bent down so that the end of the conductor bar piece together with the free end of the clamping leg forms an inlet funnel for guiding the electrical conductor to be connected.

3. Electrical supply or connecting terminal as claimed in claim 1, wherein the contact leg runs essentially perpendicular to the insertion direction of the electrical conductor to be connected, wherein the conductor bar piece rests on the retaining section and the end of the conductor bar piece rests on a free end of the contact leg.

4. Electrical supply or connecting terminal as claimed in claim 1, wherein the conductor bar piece is connected to one of a plug part and socket part.

5. Electrical supply or connecting terminal as claimed in claim 1, wherein a mounting bridge is punched out of the contact leg and bent down at an end of the recess opposite an end of the recess at which the retaining section is located.

6. Electrical supply or connecting terminal as claimed in claim 5, wherein the metal part further comprises a socket part which has two opposing legs and a bridge which connects the legs, wherein the socket part is surrounded by an over-spring, the over-spring being matched essentially to the geometry of the socket part.

7. Electrical supply or connecting terminal as claimed in claim 1, wherein the insulating housing has an actuating opening for insertion of an actuating tool, and wherein the clamping leg has a kink which is aligned in the direction of the spring force of the clamping leg for enabling a tip of the actuating tool for opening the clamping spring to act on the kink.

8. Electrical supply or connecting terminal as claimed in claim 1, wherein the metal part is made of a copper alloy.

9. Electrical supply or connecting terminal as claimed in claim 1, wherein the end of the conductor bar piece is bent down so that the end of the conductor bar piece together with the free end of the clamping leg forms an inlet funnel for guiding the electrical conductor to be connected.

10. Electrical supply or connecting terminal as claimed in claim 9, wherein the contact leg runs essentially perpendicular to the insertion direction of the electrical conductor to be connected, wherein the conductor bar piece rests on the retaining section and the end of the conductor bar piece rests on a free end of the contact leg.

11. Electrical supply or connecting terminal as claimed in claim 10, wherein a mounting bridge is punched out of the contact leg and bent down at an end of the recess opposite an end of the recess at which the retaining section is located.

12. Electrical supply or connecting terminal as claimed in claim 11, wherein the conductor bar piece is connected to one of a plug part and socket part.

13. Electrical supply or connecting terminal as claimed in claim 11, wherein the metal part further comprises a socket part which has two opposing legs and a bridge which connects the legs, wherein the socket part is surrounded by an over-spring, the over-spring being matched essentially to the geometry of the socket part.

14. Electrical supply or connecting terminal as claimed in claim 13, wherein the insulating housing has an actuating opening for insertion of an actuating tool, and wherein the clamping leg has a kink which is aligned in the direction of the spring force of the clamping leg so that the tip of the actuating tool for opening the clamping spring can act on the kink.

15. Electrical supply or connecting terminal as claimed in claim 14, wherein the metal part is made of a copper alloy.

* * * * *